US007034241B2

(12) United States Patent
Fleege et al.

(10) Patent No.: US 7,034,241 B2
(45) Date of Patent: Apr. 25, 2006

(54) EFFICIENT VENTING MEANS FOR A CIRCUIT BREAKER

(75) Inventors: Dennis William Fleege, Cedar Rapids, IA (US); Allen Leslie Lukas, Amana, IA (US); Gary Allan Volesky, Newhall, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/817,646

(22) Filed: Apr. 1, 2004

(65) Prior Publication Data

US 2005/0219021 A1 Oct. 6, 2005

(51) Int. Cl.
*H01H 33/02* (2006.01)

(52) U.S. Cl. ..... 218/157; 335/201

(58) Field of Classification Search ..... 335/8–10, 335/23–25, 201–202, 165–176, 16; 218/149–157, 218/34–35; 200/293–308
See application file for complete search history.

(56) References Cited

U.S. PATENT DOCUMENTS 2,225,791 A * 12/1940 Nau et al. ..... 200/306
5,164,693 A * 11/1992 Yokoyama et al. ..... 335/14
5,608,198 A * 3/1997 Clark et al. ..... 218/147
6,188,036 B1 * 2/2001 Arnold ..... 218/157

* cited by examiner

*Primary Examiner*—Lincoln Donovan

(57) ABSTRACT

An arrangement for reducing pressure inside a circuit breaker caused by gas produced during an electrical interruption event, including a base, an interrupter assembly, and a trip unit base. A structure having a surface is positioned in the base at an angle relative to a vent opening of the interrupter assembly. The trip unit base includes a complementary structure opposing the structure to form a cavity. The base includes a chamber area adjacent to an opening of a vent chute that leads away from the circuit breaker. During an electrical interruption event, hot explosive gas, carbon, and molten metal debris are directed away from the vent opening of the interrupter assembly along the angled surface of the structure and toward the opening of the vent chute. In this manner, pressure in the circuit breaker is reduced during an electrical interruption event, and undesirable buildup of debris is reduced.

27 Claims, 8 Drawing Sheets

EFFICIENT VENTING MEANS FOR A CIRCUIT BREAKER

FIELD OF THE INVENTION

This invention relates generally to circuit breakers, and, more specifically, to an efficient venting means for use in a circuit breaker.

BACKGROUND OF THE INVENTION

Circuit breakers are well known in the art, and are designed to trip in response to an electrical interruption event caused by an overload, short circuit, or thermal runaway condition, thereby opening the circuit to which the circuit breaker is connected and reducing the possibility of damage to the conductor wires or the loads connected to the circuit breaker. During the electrical interruption event, hot explosive gasses are generated and are released away from an interrupter assembly of the circuit breaker as the internal contacts inside the circuit breaker separate. In addition, during the electrical interruption event, molten metal debris and carbon are produced, spraying outward in the direction of the gas, and can accumulate inside the circuit breaker. The accumulation of this carbon and molten metal debris can eventually produce undesirable ground strikes or cross-phasing caused by dielectric breakdowns, reducing the electrical performance of the circuit breaker. In addition, the sudden explosion of gas causes a sudden increase in pressure in the surrounding area of the explosion.

As the overall size of the circuit breaker is reduced, vents have been introduced to vent these potentially destructive gasses and debris away from internal components of the circuit breaker. The contacts are housed inside an interrupter assembly which has an opening through which the gasses pass during an electrical interruption event. The forces caused by the pressure buildup inside the circuit breaker can cause undesirable internal or external physical damage to the housing and components of the circuit breaker. In addition, the pollution caused by a buildup of molten metal debris and carbon inside the circuit breaker can eventually cause ground strikes or dielectric breakdowns between the phases of current in the circuit breaker.

In order to meet present UL requirements, the integrity of the circuit breaker case must be maintained. Therefore, pressure caused by an electrical interruption event must be controlled and suppressed. Pressure blowouts that cause damage to a circuit breaker will fail present UL requirements and will fail customer expectations. A damaged circuit breaker may also present a safety hazard as the blowout may expose internal components of the circuit breaker to the operator or may cause internal shorting or melting of circuit-breaker components not designed for high current loads.

What is needed, therefore, is an arrangement that reduces pressure that builds up inside a circuit breaker during an electrical interruption event by employing an efficient venting means to direct gas toward vents while maintaining the physical integrity of the circuit breaker and reducing cross-phasing effects caused by accumulation of carbon and molten metal debris expelled during an electrical interruption event. The present invention is directed to satisfying this and other needs, as more fully described in the detailed description and illustrated in the accompanying drawings.

SUMMARY OF THE INVENTION

In an exemplary embodiment of the present invention, an arrangement for reducing pressure inside a chamber area of a circuit breaker caused by gas produced during an electrical interruption event includes a circuit breaker base and a structure. The base defines a chamber area and is coupled to an interrupter assembly. The interrupter assembly has a vent opening through which gas, carbon, and molten debris that is produced during the electrical interruption event passes into the chamber area. The base includes a floor, a wall portion distal the entry point of the gas from the vent opening into the chamber area, and a vent chute having an opening into the chamber area. The vent chute opening is elevated relative to the floor.

The structure is disposed in the chamber area to direct the passing gas generally away from the wall portion and generally toward the vent chute opening, thereby reducing pressure in the chamber area of the circuit breaker during the electrical interruption event. In alternate embodiments, the structure includes a wall surface angled relative to the vent opening to direct the gas toward the vent chute opening during the electrical interruption event, or an approach ramp adjacent the vent chute opening to elevate the gas away from the floor toward the vent chute opening during the electrical interruption event. The structure may be generally V-shaped, U-shaped, have a generally triangular cross-section, a generally trapezoidal cross-section, or have a rounded profile.

A trip unit base is adapted to engage walls of the base and substantially enclose the chamber area to form a cavity. The trip unit base includes a complementary structure that opposes the structure such that the two are generally flush with one another. These two structures reduce the volume of the cavity that is presented to the passing gas.

The above summary of the present invention is not intended to represent each embodiment, or every aspect, of the present invention. Additional features and benefits of the present invention are apparent from the detailed description, figures, and claims set forth below.

Figure 1:
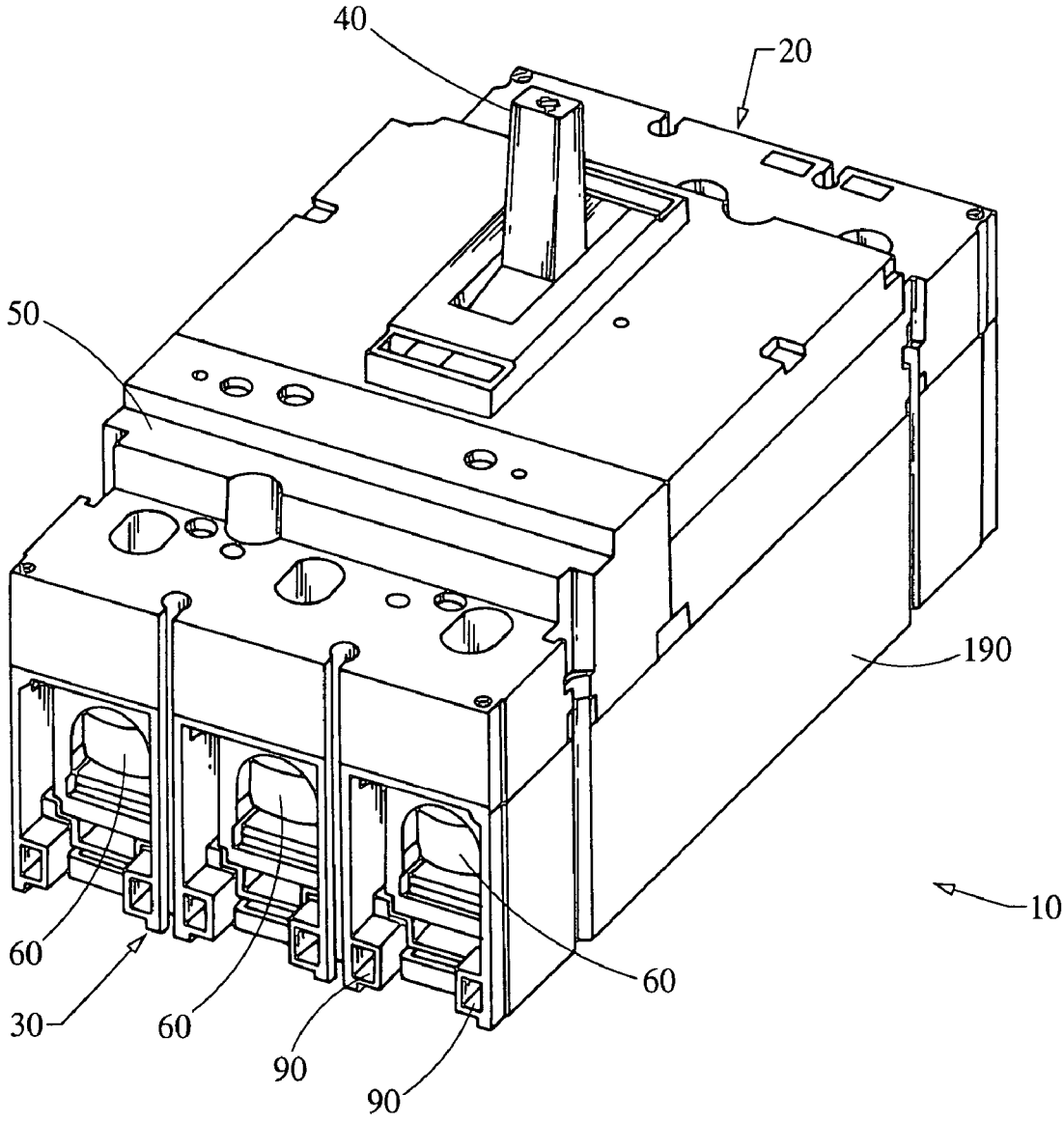
FIG. 1 is a perspective diagram of a three-pole circuit breaker according to one aspect of the present invention.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

FIG. 1 illustrates a perspective view of a three-pole circuit breaker 10 having a line end 20 and a load end 30. A handle 40 is used to reset the circuit breaker or to turn the circuit breaker 10 on, off, or can indicate a TRIPPED condition of the circuit breaker 10. Proximate the load end 30 is a tripping unit 50, operable to trip the circuit breaker 10 in the event of an overload, short circuit, or thermal runaway condition. The tripping unit 50 is sized to fit into a base 190 of the circuit breaker 10. At the line end 20 and load end 30 of the circuit breaker 10, lug assemblies 60 are used to attach conductive cables (not shown) to supply electrical current to various loads in the electrical circuit to which the circuit breaker 10 is connected. During an electrical interruption event, caused by an overload, short circuit, or thermal runaway condition, for example, hot explosive gasses are built up internally and are released through a pair of vent chutes 90 in the corresponding pole of the circuit breaker 10.

Figure 2:
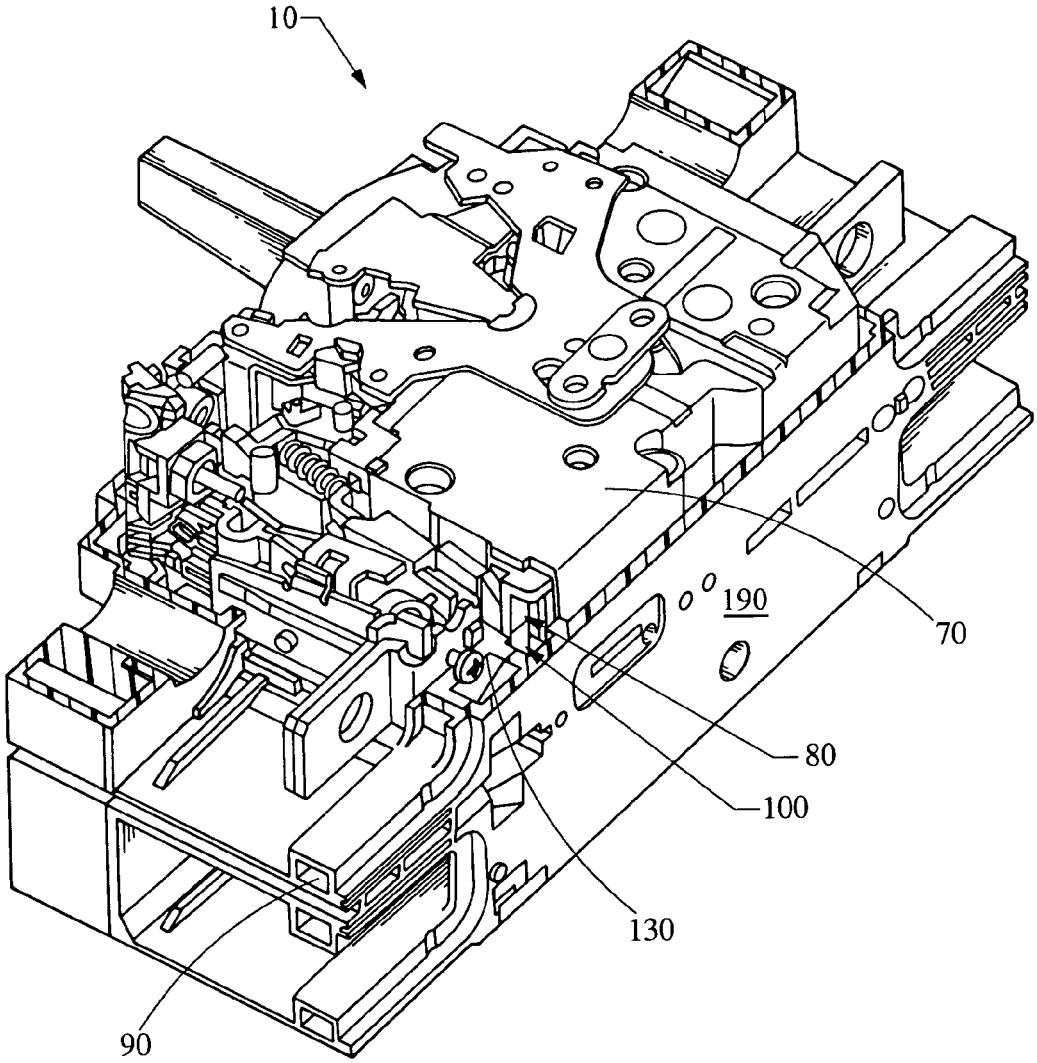
FIG. 2 is a perspective cross-sectional diagram of the circuit breaker shown in FIG. 1 with part of its housing removed to expose certain internal components of the circuit breaker.

FIG. 2 illustrates a cross section through the approximate center of the circuit breaker 10 shown in FIG. 1 to reveal an interrupter assembly 70. The separation of the contacts within the interrupter assembly 70 causes the explosion that occurs during high-level interruptions of current flow from the line end 20 to the load end 30 of the circuit breaker 10. At the time of an electrical interruption event, pressure builds up inside the interrupter assembly 70 and hot gas produced by the explosion is substantially released through a vent opening 80 of the interrupter assembly 70. This hot gas is then directed into a chamber area 100 under the tripping unit base 130.

Figure 3:
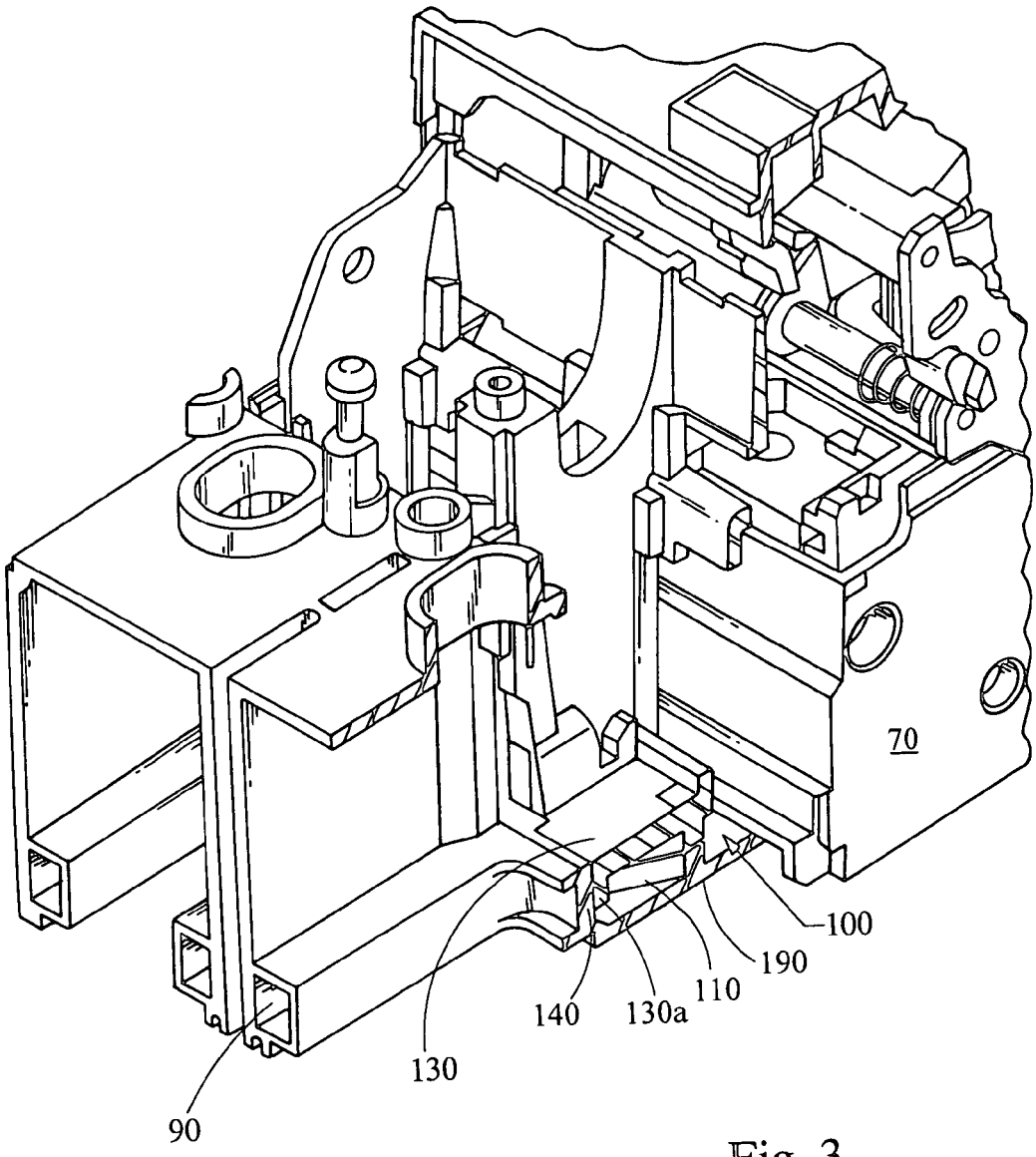
FIG. 3 is a perspective, sectional view of the circuit breaker shown in FIG. 2 illustrating part of the novel venting arrangement according to a specific aspect of the present invention.

The chamber area 100 can be more easily viewed in FIG. 3. The base 190 includes a redirection wall structure 110 and one of the vent chutes 90. The trip unit base 130 is shown mated with the base 190.

Figure 4:
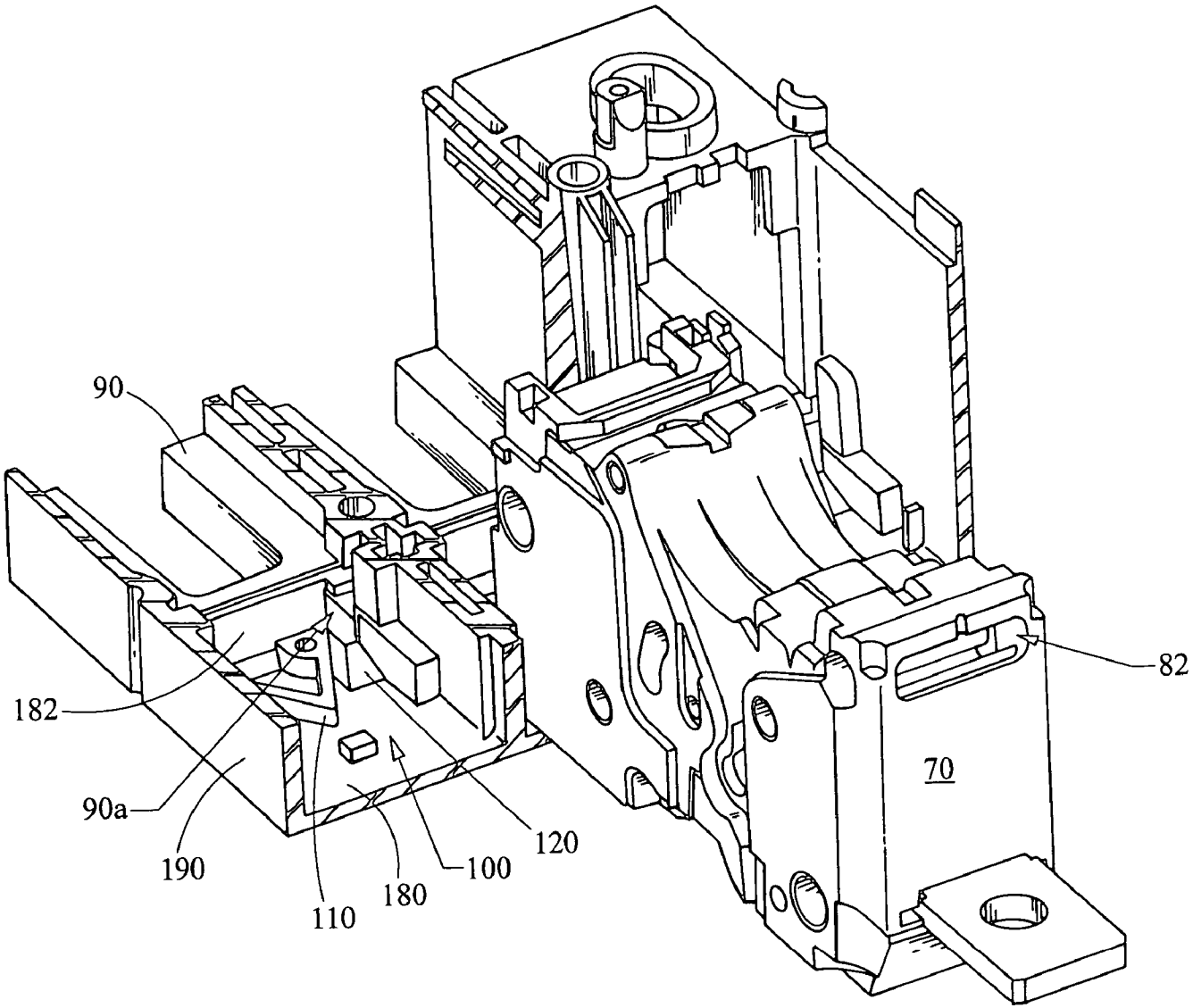
FIG. 4 is another perspective, cutaway view of part of the base of the circuit breaker shown in FIG. 2 and one interrupter assembly, illustrating structures used in the novel venting arrangement according to a specific aspect of the present invention.
Figure 5:
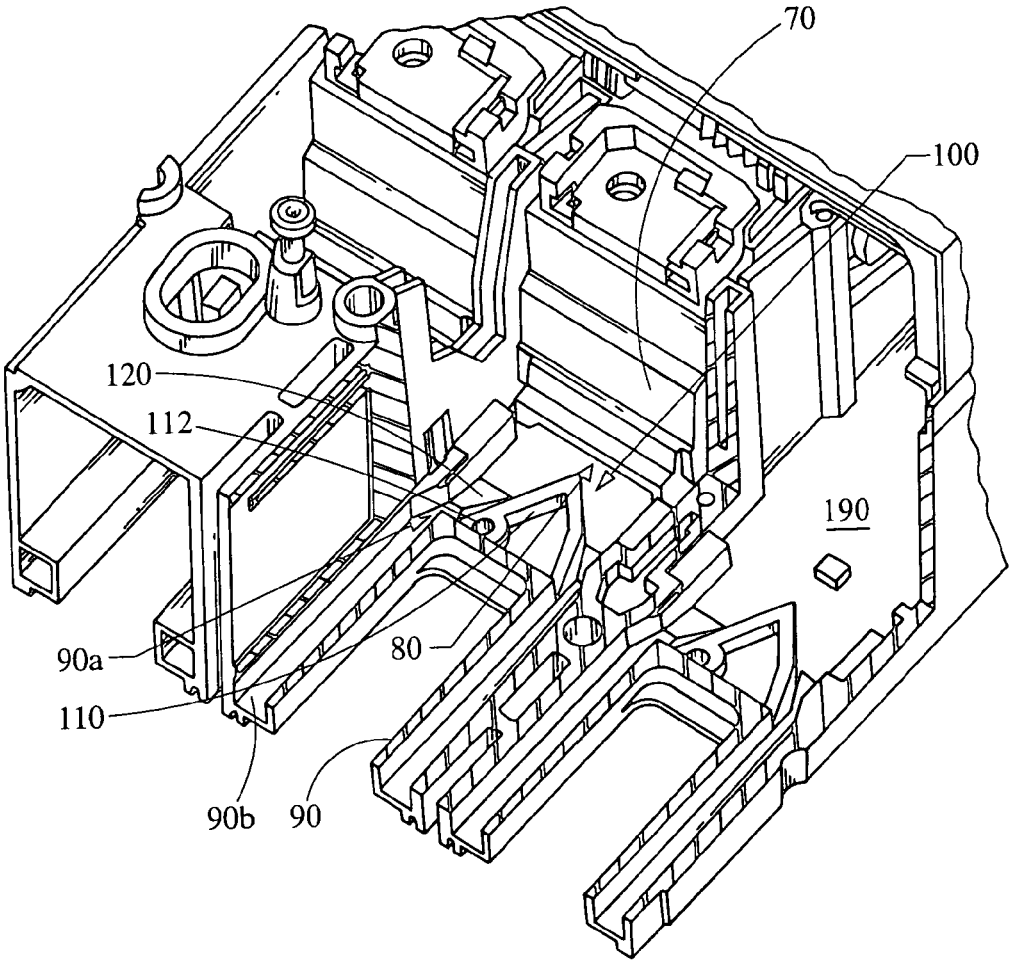
FIG. 5 is a top, perspective, cutaway view of part of the base of the circuit breaker shown in FIG. 2 along with two interrupter assemblies, showing the relationship of one of the interrupter assemblies with the novel venting arrangement according to a specific aspect of the present invention.

FIG. 4 shows part of the base 190 with the trip unit base 130 removed to expose the chamber area 100. The vent chute 90 has a vent chute opening 90*a*. An approach ramp 120 is positioned against a floor 180 of the base 190 and a rear chamber wall 182 and adjacent the vent chute opening 90*a*. The redirection wall structure 110 is positioned against the rear chamber wall 182 and walls of the structure 110 are angled to direct the gas, carbon, and molten metal debris away from the rear chamber wall 182 and toward the vent chute opening 90*a*. Gas entering the chamber area 100 from the interrupter assembly 70 will pass along the angled surfaces of the walls of the redirection wall structure 110 and along the surfaces of the approach ramps 120 (another approach ramp is obscured in FIG. 4 but is shown in FIG. 5). Using the redirection wall structure 110 and the approach ramps 120 allows the gas to "find" the vent chute openings 90*a* before the pressure in the chamber area 100 builds up to a point where internal or external damage to the circuit breaker 10 can occur. The gas flow is thus smoother and less turbulent as it is guided directly toward the vent chute openings 90*a*, reducing overall pressures. In addition, the redirection wall structure 110 and approach ramps 120 help prevent buildup of carbon and molten metal debris within the chamber area 100, reducing the possibility of dielectric breakdown between phases of the circuit breaker 10. The redirection wall structure 110 and approach ramps 120 also increase the structural integrity of the floor 180 of the base 190, further strengthening the floor 180 against damage during an electrical interruption event.

Note that in the embodiment shown in FIG. 4, the approach ramp 120 has a generally trapezoidal cross-section, and the edges of the approach ramp 120 may be smoothed for a more rounded profile. In other embodiments, the approach ramp 120 has a generally triangular cross-section. In still other embodiments, the exposed surface of the approach ramp 120 is rounded in a concave or convex manner. The guiding principle for the approach ramp is to present a smooth transition for the gas flow as it is elevated away from the floor 180 toward the vent chute opening 90*a*. Smooth transitions reduce turbulence which in turn reduces the overall pressure in the circuit breaker 10, and allows the gas to "find" the vent chute opening 90*a* quickly before excessive pressure can build up.

FIG. 5 illustrates a top view of the chamber area 100 with the trip unit base 130 removed. Here, the path of gas flow can be better viewed starting from the vent opening 80 of the interrupter assembly 70 and into the chamber area 100. The path is split by the redirection wall structure 110 followed by the approach ramps 120 which change the elevation of the gas to align with the opening of the vent chutes 90. The gas then flows from the vent chute openings 90*a*, through the respective vent chutes 90, and is released into free air at the end of the vent chutes 90*b*.

The redirection wall structure 110 forms a substantially V-shaped structure. In other embodiments, the redirection wall structure 110 forms a substantially U-shaped or triangular structure. Generally, at least one edge of the redirection wall structure is positioned at an angle relative to the vent opening 80 to direct gas from the vent opening 80 toward the vent chute opening 90*a*. The structure in the chamber area 100 may be curved or straight (as illustrated), incorporated into the base 190 (as illustrated) or coupled to the base 190, and/or it may be fixed (as illustrated) or movable in alternate embodiments.

The registration hole 112 shown in the redirection wall structure 110 is used to register the trip unit base 130 when it is installed over the base 190. The trip unit base 130 includes a protrusion adapted to mate with the registration hole 112 to facilitate assembly of the trip unit base 130 with the base 190. The registration hole 112 can also be used to permit only trip units of a certain amperage to be installed into the circuit breaker 10.

Figure 6:
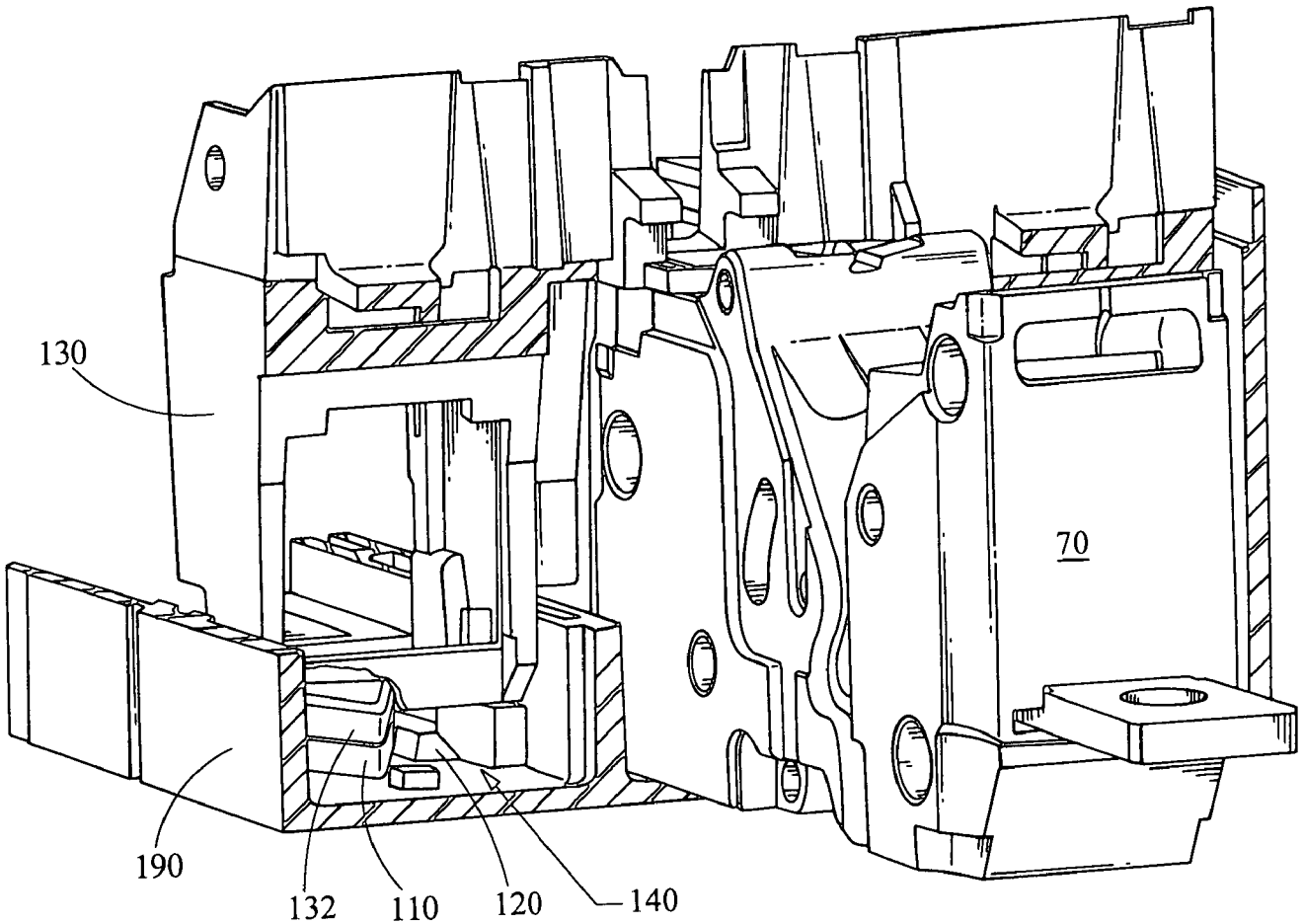
FIG. 6 is a perspective, sectional view part of the base of the circuit breaker shown in FIG. 2 along with a trip unit base and an interrupter assembly, showing the relationship of the trip unit base with the novel venting arrangement according to a specific aspect of the present invention.

FIG. 6 illustrates the trip unit base 130 assembled with the base 190 to form a cavity 140. The bottom of the trip unit base 130 includes a complementary redirection structure 132 that is positioned opposite the redirection wall structure 110. The complementary arrangement of structures 110, 132 substantially prevents any gas or debris from impacting the rear wall chamber 182. The area behind the structures 110, 132 and adjacent to the rear wall chamber 182 is a protected area in that substantially no gas or debris enters this area during an electrical interruption event.

Figure 7:
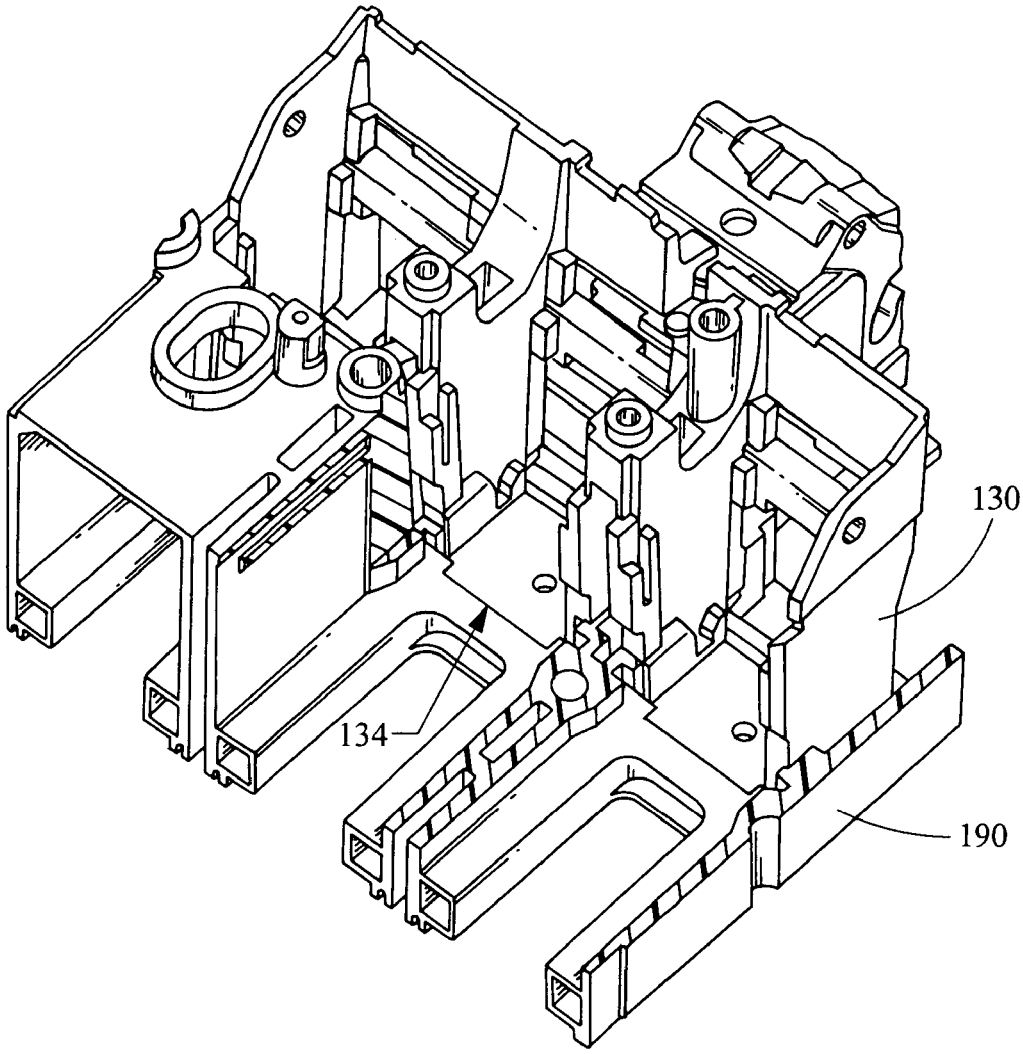
FIG. 7 is a perspective, cutaway view of the circuit breaker shown in FIG. 5, illustrating part of the trip unit base installed in the base of the circuit breaker.

FIG. 7 illustrates a top perspective view of the base 190 and the trip unit base 130 assembled together. Note that only one interrupter assembly is shown for one pole of the circuit breaker 10. To prevent gas leakage into the area above the trip unit, a tight fit is important between the base 190 and the trip unit base 130 in the area 134 around the rear chamber wall 182. As shown in FIG. 3, a frontal edge profile 130*a* of the trip unit base 130 and an edge profile 140 of the chamber area 100 oppose each other. The frontal edge profile 130*a* extends downwardly into the chamber area 100 and is flush against the edge profile 140. The registration hole 112 helps to ensure that the profiles 130*a*, 140 are positioned to provide a seal between the base 190 and the trip unit base 130. Without a good seal, gas can escape the chamber area 100 between the profiles 130*a*, 140, potentially causing physical damage to the circuit breaker 10.

Figure 8:
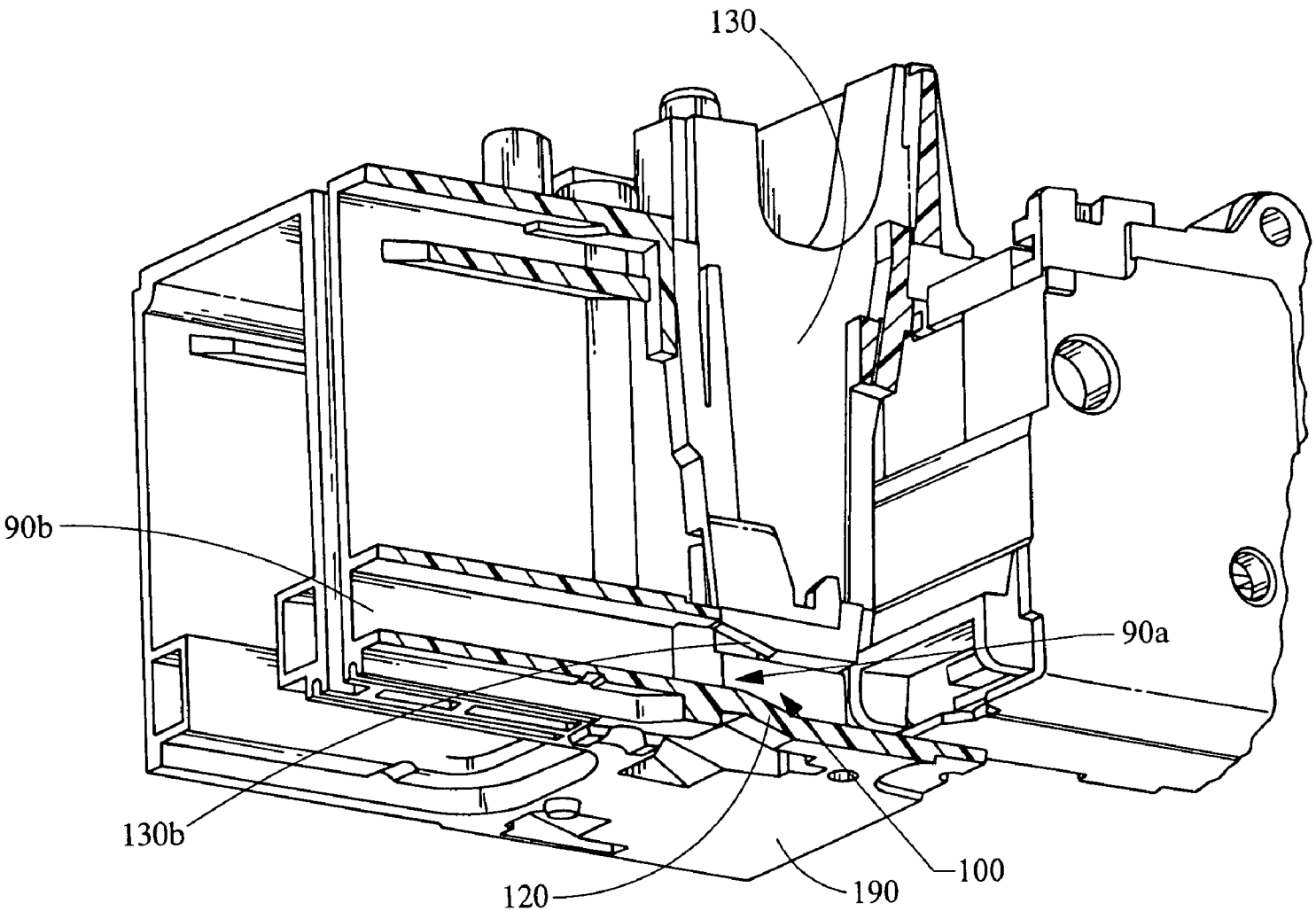
FIG. 8 is a perspective, cutaway view of the circuit breaker shown in FIG. 7, revealing the underside of the trip unit base in relation to the base of the circuit breaker.

FIG. 8 is a section view of the path of gas flow illustrating the approach ramp 120 and a corresponding angled surface 130*b* on the bottom of the trip unit base 130, which maintains a generally uniform height of the chamber area 100 to facilitate a steady flow of gas for venting out of the vent chute 90.

In alternate embodiments, the circuit breaker 10 is a single-break or double-break circuit breaker. In the latter case, vent chutes are disposed at both the line end 20 and load end 30 of the circuit breaker 10. A second vent opening 82 (shown in FIG. 4) in the interrupter assembly 70 disposed toward the line end 20 leads to a second chamber area (not shown) with corresponding structures for directing gas out of vent chutes into free air without causing physical damage to the circuit breaker 10.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. In a circuit breaker, an arrangement for venting gas produced during an electrical interruption event, comprising:

a base having at least one chamber area, said base having at least one opening adjacent said at least one chamber area, said at least one opening leading to a vent chute;

a trip unit engaged to mate with at least a portion of said base and substantially enclosing said at least one chamber area with said base to form a cavity; and a structure in said cavity adjoining said vent chute, said structure directing gas caused by said electrical interruption event generally toward said at least one opening, said structure having an edge portion angled toward said at least one opening such that during said electrical interruption event gas is directed along said angled edge portion to said vent chute to direct said gas generally away from said circuit breaker.

2. The arrangement of claim 1, wherein said trip unit includes a trip unit base having a complementary structure, said complementary structure having an edge portion angled toward said at least one opening such that said gas is directed along said angled edge portion of said structure and said angled edge portion of said complementary structure to said at least one opening during said electrical interruption event.

3. The arrangement of claim 2, wherein said structure and said complementary structure are generally flush with one another.

4. The arrangement of claim 1, wherein said base includes a floor, said at least one opening being positioned a distance elevated from said floor, said angled edge portion of said structure providing a continuous surface from said floor to said at least one opening.

5. The arrangement of claim 4, wherein said base further includes a second structure having a surface leading away from said floor to elevate said gas away from said floor and toward said at least one opening during said electrical interruption event.

6. In a circuit breaker, an arrangement for reducing pressure inside a chamber area of said circuit breaker caused by gas formed during an electrical interruption event, comprising:

a base defining at least one chamber area, said base being coupled to an interrupter assembly such that gas produced by tripping said interrupter assembly during an electrical interruption event passes generally from a vent opening of said interrupter assembly into said at least one chamber area, said base including:

a wall portion distal the entry point of said gas from said interrupter assembly into said at least one chamber area, and a vent chute having an opening into said at least one chamber area; and a wall structure disposed on said base in said at least one chamber area and adjoining said vent chute to direct the passing gas generally away from said wall portion and generally toward said opening of said vent chute, thereby reducing pressure in said chamber area of said circuit breaker during said electrical interruption event.

7. The arrangement of claim 6, wherein the area between said wall portion and said wall structure defines a protected area in which substantially no gas enters during said electrical interruption event.

8. The arrangement of claim 6, wherein said wall structure is generally one of V-shaped and U-shaped.

9. The arrangement of claim 6, wherein said base further includes a floor, said opening of said vent chute being positioned a distance away from said floor, the arrangement further including an approach ramp adjacent said opening, said approach ramp having a surface leading away from said floor to direct said gas generally toward said opening and away from said floor.

10. The arrangement of claim 6, further including a trip unit having a trip unit base adapted to engage walls of said base and substantially enclose said at least one chamber area to form a cavity.

11. The arrangement of claim 10, wherein said trip unit includes a complementary wall structure positioned to oppose said wall structure such that said complementary wall structure and said wall structure are generally flush with one another.

12. The arrangement of claim 11, wherein said wall structure and said complementary wall structure operate to reduce the volume of said cavity through which said gas passes.

13. The arrangement of claim 6, wherein the presence of said wall structure in said at least one chamber area prevents physical damage to said base due to pressure that builds up in said at least one chamber area during said electrical interruption event.

14. The arrangement of claim 6, wherein said wall structure directs debris caused by an explosion of said gas generally away from said wall portion and generally toward said opening, said vent chute further directing at least some of said debris away from said circuit breaker during said electrical interruption event.

15. A circuit breaker, comprising:

a base defining at least one chamber area and including a vent chute having an opening adjacent to said at least one chamber area;

an interrupter assembly having a vent opening adjacent said at least one chamber area, said vent opening adapted to vent gas produced during an electrical interruption event generally away from said interrupter assembly and generally toward said at least one chamber area, and said base further including at least one structure adjoining said vent chute in said at least one chamber area and having a surface angled with respect to a floor of said base toward said vent chute opening to direct the gas passing generally away from said interrupter assembly toward said vent chute along said surface such that the physical integrity of said base of said circuit breaker is maintained during said electrical interruption event.

16. The circuit breaker of claim 15, wherein said opening of said vent chute is elevated relative to said floor, the circuit breaker further including an approach ramp adjacent said vent chute opening, said approach ramp having a surface angled from said floor to said vent chute opening to elevate said gas generally toward said vent chute opening.

17. The circuit breaker of claim 16, wherein a cross section of said approach ramp is generally the shape of one of a triangle and a trapezoid.

18. A circuit breaker, comprising:

a base defining at least one chamber area and including first vent chute and a second vent chute;

an interrupter assembly having a vent opening adjacent said at least one chamber area, said vent opening adapted to vent gas produced during an electrical interruption event generally away from said interrupter assembly and generally toward said at least one chamber area, and said base further including a first structure in said at least one chamber area and having a first edge angled with respect to said vent opening to direct the gas passing generally away from said interrupter assembly toward said first vent chute, said first edge adjoining said first vent chute, and a second edge angled with respect to said vent opening to direct the gas passing generally away from said interrupter assembly toward said second vent chute, said second edge being adjacent to said second vent chute, thereby reducing pressure in said chamber area of said circuit breaker during said electrical interruption event.

19. The circuit breaker of claim 18, wherein said at least one structure generally forms a triangle having two edges exposed to said gas, said gas passing along said two edges generally toward respective ones of said first and second vent chutes.

20. In a circuit breaker, an arrangement for venting gas produced during an electrical interruption event, comprising:

a base defining at least one chamber area, said base having at least one opening adjoining said at least one chamber area and leading to a vent chute having a vent chute opening;

means for interrupting electrical current to the electrical circuit to which said circuit breaker is connected, said means for interrupting including a vent opening leading to said at least one chamber area, said gas produced during said electrical interruption event passing through said vent opening; and in said at least one chamber area, means, adjacent said vent chute, for directing gas produced by said electrical interruption event generally toward said vent chute opening.

21. The arrangement of claim 20, wherein said means for interrupting is an interrupter assembly.

22. The arrangement of claim 20, wherein said means for directing is a structure having at least one surface angled toward said at least one opening such that said gas is directed along said angled surface to said at least one opening during said electrical interruption event.

23. The arrangement of claim 22, wherein said structure is generally one of V-shaped and U-shaped.

24. The arrangement of claim 22, wherein said structure is an approach ramp having a cross section that is generally one of a triangle and a trapezoid, said approach ramp elevating said gas toward said at least one opening during said electrical interruption event.

25. The arrangement of claim 20, wherein said at least one opening leads to a vent chute having a substantially elongated shape to direct said gas generally away from said circuit breaker.

26. The arrangement of claim 20, wherein said means for directing further directs debris produced during said electrical interruption event away from at least one wall of said base to reduce the undesirable effects of cross-phasing.

27. In a circuit breaker, an arrangement for venting gas produced during an electrical interruption event, comprising:

a base having at least one chamber area and a floor, said base having at least one opening adjacent said at least one chamber area and positioned a distance elevated from said floor, said at least one opening leading to a vent chute;

a trip unit engaged to mate with at least a portion of said base and substantially enclosing said at least one chamber area with said base to form a cavity; and a structure in said cavity and adjacent to said vent chute, said structure directing gas caused by said electrical interruption event generally toward said at least one opening, said structure having an edge portion angled toward said at least one opening and providing a continuous surface from said floor to said at least one opening such that during said electrical interruption event gas is directed along said angled edge portion to said vent chute to direct said gas generally away from said circuit breaker.

* * * * *